United States Patent [19]

Torimoto et al.

[11] Patent Number: 4,895,785

[45] Date of Patent: Jan. 23, 1990

[54] SPHERICAL TONER PARTICLE

[75] Inventors: Yoshiaki Torimoto; Yoshitsugu Shirasaki, both of Wakayama, Japan

[73] Assignee: Kao Corporation, Tokyo, Japan

[21] Appl. No.: 293,067

[22] Filed: Jan. 3, 1989

Related U.S. Application Data

[62] Division of Ser. No. 73,086, Jul. 14, 1987, abandoned.

[30] Foreign Application Priority Data

Jul. 14, 1986 [JP] Japan ..... 61-165305

[51] Int. Cl.[4] ..... G03G 9/08

[52] U.S. Cl. ..... 430/137; 523/215; 430/111

[58] Field of Search ..... 430/137; 523/215

[56] References Cited

U.S. PATENT DOCUMENTS 4,077,804 3/1978 Vanzo ..... 430/137
4,231,919 11/1980 Isaacson ..... 430/137 X

FOREIGN PATENT DOCUMENTS 59-28164 2/1984 Japan ..... 430/137
60-243664 12/1985 Japan ..... 430/137

*Primary Examiner*—Roland E. Martin
*Attorney, Agent, or Firm*—Birch, Stewart, Kolasch & Birch

[57] ABSTRACT

A toner particle composition substantially spherical in form and comprising binder resin and carbon black dispersed thereon, the surface area of the particle being covered with the carbon black in an amount not greater than 25 percent of the entire surface area of the toner particle.

3 Claims, No Drawings

SPHERICAL TONER PARTICLE

This application is a divisional of copending application Ser. No. 07/073,086, filed on Jul. 14, 1987, now abandoned.

BACKGROUND OF THE INVENTION

The present invention relates to a toner for developing an electrostatically charged image in electrophotography, electrostatic recording or electrostatic printing.

Up to this time, an electrostatically charged image formed on a recording medium in electrophotography, electrostatic recording or electrostatic printing has been developed by two main methods, i.e., a wet developing method using a developer comprising a fine dispersion of various pigments or dyes in an insulating liquid or a dry developing method using a finely powdered developer called toner and prepared by dispersing a coloring material in a natural or synthetic resin. Examples of the latter method include cascade development, manual brushing, magnetic brushing, impression development and powder cloud development. The present invention relates to a toner suitable for the dry developing methods.

Up to this time, a toner for developing an electrostatically charged image has been prepared by dispersing a coloring material in a soft polymer by melting, kneading and grinding the obtained polymer containing the coloring material dispersed therein. However, the powder obtained by this process has a very wide particle size distribution so that the powder must be classified prior to the practical use as a toner. Thus, the process itself is disadvantageous in complexity and cost.

Further, the toner prepared by the above process involving a grinding step has edges and small cracks. Therefore, the resulting toner has poor fluidity and when it is stirred in a developing device these edges and small cracks break to generate dust which causes a lowering in the quality of the image, or scumming, thus shortening the life of the image.

On the other hand, several polymerization processes for directly preparing a colored polymer particle not involving a grinding step have been proposed in, for example, Japanese Patent Publication Nos. 10231/1961, 51830/1972 and 14895/1976 and Japanese Patent Laid-Open Nos. 17735/1978, 17736/1978 and 17737/1978.

These processes comprise suspending an oil phase containing a monomer, a polymerization initiator and a coloring material in an aqueous medium and polymerizing the obtained suspension to directly obtain a toner and relate to so-called suspension polymerization.

These processes have advantages in that the obtained toner is spherical and excellent in fluidity and in that the preparation process itself is simple and the cost is low.

However, the toner prepared by these processes has disadvantages in that the properties are highly dependent upon humidity and therefore is poor in humidity resistance and electrostatic chargeability such that the electrostatic chargeability and the maintenance of a charge are insufficient even at ordinary temperature and humidity so as to give a low-quality image.

The reason for the above disadvantages have been researched and, as a result, the following thoughts presented. Since carbon black, which has been uniformly dispersed among monomers at the initiation of suspension polymerization, gathers near the surface of the toner particle during the polymerization, the surface resistance of the obtained toner is lowered, so that the electrostatic chargeability and charge stability of the toner are also lowered, of which the latter is particularly lowered at high humidity.

SUMMARY OF THE INVENTION

It has been determined that the above disadvantages can be overcome by employing a spherical toner characterized in that the ratio of the area of the surface of the toner covered with carbon black to the whole surface area of the toner does not exceed a specified value. The present invention has been accomplished on the basis of this finding.

Thus the present invention provides a spherical toner characterized in that the ratio of the area of the surface of the toner covered with carbon black to the whole surface area of the toner is not more than 25%, preferably not more than 15%.

A toner composition of the invention comprises particles substantially in spherical form of a binder resin and carbon black, the surface area of the toner particle covered with the carbon black being 25 percent or smaller of the entire surface area of the toner particle.

DETAILED DISCUSSION

The toner composition of the present invention is produced by dispersing carbon black, a polymerization initiator, a charge control agent and one or both of a hydrophobic dispersant, and a thickening agent in a binder resin of a monomer having a polymerizable unsaturation to obtain the oily phase, adding the resulting oily phase into water containing a dispersion stabilizer to obtain a dispersion, agitating the dispersion at such a high rate so as to produce a fine particle of the oil phase in the water, polymerizing the dispersion and recovering the obtained toner particles.

The hydrophobic dispersant includes, for example, an inorganic dispersant such as calcium silicate, silicon carbide and magnesium silicate and an organic dispersant such as an alkenyl succinic imide, polyethyleneimine and a derivative thereof.

The thickening agent includes, for example, aluminum dialkyl phosphate, aluminum stearate, 12-hydroxystearic acid and dibenzylidene sorbitol and other conventional thickening agents and conventional gelation agents. A polymer being soluble in the monomer may be used. The thickening agent serves to prevent carbon black from moving toward the surface of the toner particle during the polymerization step. It is preferable so that the toner particle is free of trouble due to electric charging.

The term "spherical toner" used in this specification refers not only to one of a genuine sphere but also to one of a distorted sphere such as cocoon-like shape. That is to say, the spherical toner particle according to the present invention may have edges or undulations microscopically, so long as it does not have any edge on its surface macroscopically.

The ratio of the area of the surface of the toner particle covered with carbon black to the whole surface area of the toner is determined as follows:

Toner particles are added to an epoxy resin. The resulting resin is cut into thin films, each having a thickness of several hundreds Å. The thin film is photographed with an electron microscope of the transmission type. The obtained photograph is analyzed for the state (dispersibility, agglomeration, number of particles and the like) of carbon black with an image analyzer.

The ratio of the area of the surface of the toner covered with carbon black to the whole surface area of the toner is calculated by the following equation:

$$a/b \times 100(\%)$$

wherein b is the full length of a boundary line between the toner and the space, i.e., a line forming the periphery of the toner, in a cross-sectional photograph of the toner, and a is the length of the part of the above line covered with carbon black.

The spherical toner according to the present invention can be prepared by suspension polymerization. An oily dispersion obtained by dispersing a polymerization initiator, a charge controller, carbon black and the above shown additive(s) in an $\alpha,\beta$-unsaturated monomer is added to an aqueous medium obtained by homogeneously dissolving a water-soluble polymer or dispersing a suspension stabilizer, such as an inorganic salt which is difficultly water-soluble, in water. The resulting mixture is homogenized with a homomixer or homogenizer to form an oily disperse phase of 5 to 30 $\mu$m. The weight ratio of the oily phase to the aqueous phase is between 1:2 and 1:10 and is so selected as not to cause cohesion of particles during the polymerization. The homogeneous O/W dispersion thus prepared is transferred to a separable flask fitted with a stirrer, a condenser, a thermometer and a nitrogen gas inlet tube and heated to a temperature (50° to 90° C.), at which the polymerization initiator can be decomposed in a nitrogen atmosphere, to carry out the polymerization.

After the completion of the polymerization, the polymerization mixture is filtered to remove the aqueous phase. When inorganic powder adheres to the surface of the product, the product is treated with a dilute acid to remove the powder. The resulting product is washed with water and dried by spray drying, vacuum drying or the like to obtain the objective toner.

The $\alpha,\beta$-unsaturated monomer to be used in the present invention may be any suitable one. Examples of $\alpha,\beta$-unsaturated monomers include styrene, p-chlorostyrene, p-methylstyrene, vinyl acetate, vinyl propionate, vinyl benzoate, methyl acrylate, ethyl acrylate, n-butyl acrylate, iso-butyl acrylate, 2-ethylhexyl acrylate, lauryl acrylate, n-octyl acrylate, methyl methacrylate, ethyl methacrylate, n-butyl methacrylate, iso-butyl methacrylate, lauryl methacrylate, diethylaminoethyl methacrylate, t-butylaminomethyl mathacrylate, acrylonitrile, 2-vinylpyridine and 4-vinylpyridine. These monomers may be used alone or as a mixture of two or more of them.

According to the present invention, a polyfunctional monomer may be used as a crosslinking agent in addition to the above monomer to further enhance the endurance of the toner. The amount of the polyfunctional monomer used may be from 0.05 to 20% by weight, preferably 0.5 to 5% by weight based on the monomer.

The polymerization initiator to be used in the present invention may be a conventional oil-soluble peroxide or azo initiator. Examples thereof include benzoyl peroxide, lauroyl peroxide, 2,2'-azobisisobutyronitrile, 2,2'-azobis(2,4-dimethylvaleronitrile), o-chlorobenzoyl peroxide and o-methoxybenzoyl peroxide. The polymerization initiator may be used in an amount of from 0.1 to 10% by weight, preferably 0.5 to 5% by weight based on the monomer.

Examples of the suspension stabilizer to be used in the present invention include water-soluble polymers, such as gelatin, starch, hydroxyethylcellulose, carboxymethylcellulose, polyvinylpyrrolidone, polyvinyl alkyl ether and polyvinyl alcohol and inorganic salts which are difficultly soluble in water, such as barium sulfate, calcium sulfate, barium carbonate, calcium carbonate, magnesium carbonate and calcium phosphate. The suspension stabilizer may be used in an amount of from 0.1 to 5% by weight, preferably 0.5 to 2% by weight based on the water.

The toner according to the present invention may further contain a low-molecular weight olefin polymer which is known as a so-called parting agent for the purpose of the inhibition of offset and the improvement in fluidity and fixability.

It is preferable that this low-molecular weight olefin polymer be present in the polymerization system together with a coloring material.

Examples of the low-molecular weight olefin polymer to be used in the toner of the present invention include polyethylene, polypropylene, ethylene-vinyl acetate copolymer, chlorinated polyethylene wax, polyamide, polyester, polyurethane, polyvinyl butyral, butadiene rubbers, phenolic resins, epoxy resins, rosin-modified resins, silicone oil and silicone wax.

The toner obtained according to the present invention preferably has a softening point of 106° to 160° C. and a glass transition temperature of 50° to 80° C. If the softening point is lower than 106° C., no sufficient non-offset range will be attained, while if the point exceeds 160° C. the minimum fixing temperature will be too high and other unfavorable phenomena will occur. On the other hand, if the glass transition temperature is lower than 50° C., the resulting toner will be poor in storage stability, while if it exceeds 80° C., the fixability will be unfavorably lowered.

Although the carbon black to be used in the present invention is not particularly limited and may be any commercially available one, it is preferable to use a hydrophobic carbon black having a low oil-absorbing power, because the use of such carbon black enables the easy preparation of the toner of the present invention.

Carbon black is generally present in a toner particle as a secondary agglomerate rather than in a monodisperse state. According to the present invention, carbon black must be dispersed in a toner particle in such a way that no carbon black is present on the surface of the toner or in such a way that the ratio of the area of the surface of the toner particle covered with carbon black to the whole surface area of the toner is not more than 25%, when carbon black is present on the surface thereof.

As described above, the toner of the prior art obtained by grinding has disadvantages in that it is poor in fluidity and in that the breakage of the toner proceeds in service to cause scumming or lowering in the quality of the resulting image, thus shortening the life of the developer. On the other hand, although the spherical toners proposed in the above Japanese Patent Publication and Laid-Open Publications are free from the above disadvantages, they exhibit charging characteristics which are unstable, particularly against environmental change.

The toner according to the present invention exhibits charging characteristics which are stable against any environmental change. For example, the charging characteristics are constant at ordinary temperature and ordinary humidity (25° C., 50%), at high temperature and high humidity (35° C., 85%) and at low temperature and low humidity (15° C., 35%). Since, further, the toner is excellent in fluidity and is not broken in service, no dust is generated and therefore neither scumming nor lowering in the quality of the resulting image occurs. Such a toner particle is now provided by the present invention for the first time.

PREFERRED EMBODIMENTS

The present invention will be described in more detail by the following Examples, though it is not limited to them. In the Examples, all parts percentages are by weight.

EXAMPLE 1

85 parts of styrene, 15 parts of 2-ethylhexyl acrylate (2EHA), 2 parts of a charge controller (TRH, a product of Hodogaya Chemical Co., Ltd.), 8 parts of carbon black (Printex 150T; a product of DEGUSSA), 0.5 part of aluminum stearate and 3 parts of polyethylene wax (a product of Mitsui Petrochemical Industries, Ltd.; 210 P) were mixed to obtain a mixture.

500 parts of water and 1 part of polyvinyl alcohol were added to 100 parts of the mixture. The obtained mixture was homogenized by stirring at a high rate of 10,000 rpm with a homomixer (a product of Tokushu Kakoki Co., Ltd.; TK) to obtain a fine dispersion. This dispersion was transferred to a separable flask fitted with stirring blades to carry out the suspension polymerization at 60° C. for 9 hours. The polymerization mixture was washed with hot water of 50° C. and dried to obtain a toner.

0.5 g of the toner was homogeneously dispersed in a liquid mixture comprising 9.3 ml of an epoxy resin (Epoc 812), 4.0 ml of dodecenylsuccinic anhydride (DDSA), 6.7 ml of methyl nadic anhydride (MNA) and 0.3 ml of tri(dimethylaminomethyl)phenol (DMP-30). The obtained dispersion was allowed to stand at an ordinary temperature for 2 days.

The obtained toner-containing epoxy resin was cut into thin films having a thickness of several hundreds of Å with a microtome (a product of Nissei Sangyo Co., Ltd.; MT2-B). The thin film sample was subjected to electron microscopy with an electron microscope of transmission type (a product of JEOL, Ltd.).

The obtained electron microscope photograph was analyzed with an image analyzer (a product of Nippon Regulator Co., Ltd.; LUZEX-500) for the disperse state of carbon black in the crossection of the toner.

3% of the whole surface area of the obtained toner particle was covered with carbon black.

A developer was prepared by the use of the toner and a commercially available ferrite carrier having a particle size distribution of 150/250 mesh at a toner/carrier ratio of 4/96 and applied to a duplicating machine (Ricoh FT 4060). The obtained image was evaluated.

A clear image free from fogging and scumming was obtained under any environmental condition among those of low temperature and low humidity (15° C., 30%), ordinary temperature and ordinary humidity (25° C., 50%) and high temperature and high humidity (35° C., 85%).

Further, the printing using the above developer was repeated at an ordinary temperature and an ordinary humidity ten thousand times. Good images were obtained until the last without any change in the quantity of charge.

EXAMPLE 2

85 parts of styrene, 15 parts of 2EHA, 2 parts of a charge controller (a product of Hodogaya Chemical Co., Ltd.; TRH), 8 parts of carbon black (a product of DEGUSSA; Printex 150T), 0.5 part of silicon carbide and 3 parts of polyethylene wax (a product of Mitsui Petrochemical Industries, Ltd.; 210P) were mixed to obtain a mixture.

500 parts of water and 1 part of polyvinyl alcohol were added to 100 parts of the mixture. The obtained mixture was homogenized by stirring at a high rate of 10,000 rpm with a homomixer (a product of Tokushu Kakoki Co., Ltd.; TK) to obtain a fine dispersion. This dispersion was transferred to a separable flask fitted with stirring blades to carry out the suspension polymerization at 60° C. for 9 hours. The polymerization mixture was washed with hot water of 50° C. and dried to obtain an objective toner.

0.5 g of the toner was homogeneously dispersed in a liquid mixture comprising 9.3 ml of an epoxy resin (Epoc 812), 4.0 ml of DDSA, 6.7 ml of MNA and 0.3 ml of DMP-30. The obtained dispersion was allowed to stand at an ordinary temperature for two days.

The obtained toner-containing epoxy resin was cut into thin films having a thickness of several hundreds of Å with a microtome (a product of Nissei Sangyo Co., Ltd.; MT2-B). This thin film sample was subjected to electron microscopy with an electron microscope of transmission type (a product of JEOL, Ltd.).

The obtained electron microscope photograph was analyzed with an image analyzer (a product of Nippon Regulator, Co., Ltd.; LUZEX-500) for the disperse state of carbon black in the crosssection of the toner.

10% of the whole surface area of the obtained toner was covered with carbon black.

A developer was prepared by the use of the toner and a commercially available ferrite carrier having a particle size distribution of 150/250 mesh at a toner/carrier ratio of 4/96 and applied to a duplicating machine (Ricoh FT4060). The obtained image was evaluated.

A clear image free from fogging and scumming was obtained under any environmental condition among those of low temperature and low humidity (15° C., 30%), ordinary temperature and ordinary humidity (25° C., 50%) and high temperature and high humidity (35° C., 85%).

The printing using the above developer was repeated at an ordinary temperature and an ordinary humidity ten thousand times. Good images were obtained until the last without any change in the quantity of charge.

COMPARATIVE EXAMPLE 1

85 parts of styrene, 15 parts of 2EHA, 2 parts of a charge controller (a product of Hodogaya Chemical Co., Ltd.; TRH), 8 parts of carbon black (a product of Mitsubishi Chemical Industries, Ltd.; #44) and 2 parts of polyethylene wax (Mitsui Petrochemical Industries, Ltd.; 210P) were mixed to obtain a mixture.

500 parts of water and 1 part of polyvinyl alcohol were added to 100 parts of the mixture. The obtained mixture was homogenized by stirring at a high rate of 10,000 rpm with a homomixer (a product of Tokushu Kakoki Co., Ltd.; TK) to obtain a fine dispersion. This dispersion was transferred to a separable flask fitted with stirring blades to carry out the suspension polymerization at 60° C. for 9 hours. The polymerization mixture was washed with hot water of 50° C. and dried to obtain a control toner.

0.5 g of the toner was homogeneously dispersed in a liquid mixture comprising 9.3 ml of an epoxy resin (Epoc 812) 4.0 ml of DDSA, 6.7 ml of MNA and 0.3 ml of DMP-30. The obtained dispersion was allowed to stand at an ordinary temperature for two days.

The obtained toner-containing epoxy resin was cut into thin films having a thickness of several hundreds of Å with a microtome (a product of Nissei Sangyo Co., Ltd.; MT2-B). This thin film sample was subjected to electron microscopy with an electron microscope of transmission type (a product of JEOL, Ltd.).

The obtained electron microscope photograph was analyzed with an image analyzer (a product of Nippon Regulator, Co., Ltd.; LUZEX-500) for the disperse state of carbon black in the crosssection of the toner.

35% of the whole surface area of the obtained toner was covered with carbon black.

A developer was prepared by the use of the toner and a commercially available ferrite carrier having a particle size distribution of 150/250 mesh at a toner/carrier ratio of 4/96 and applied to a duplicating machine (Ricoh FT 4060). The obtained image was evaluated. Under the condition of high temperature and high humidity, the density of the image was lowered to give a very uneven and obscure image.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method of preparing a spherical toner particle which comprises dispersing carbon black, a polymerization initiator, a charge control agent, a hydrophobic dispersant and/or a thickening agent in a monomer having a polymerizable unsaturation producing an oily phase dispersion, adding said oily phase dispersion into water containing a dispersion stabilizer producing a polymerization dispersion, and polymerizing said monomer from said polymerization dispersion to produce a toner particle substantially spherical in form characterized in that the ratio of the area of the surface of the toner particle covered with carbon black to the whole surface area of the toner is not greater than 25 percent.

2. The method of claim 1, further including the step of agitating said polymerization dispersion at such a rate so as to produce fine particles of said oily phase prior to polymerization of said toner particle.

3. The method of claim 1, wherein said thickening agent comprises aluminum stearate.

* * * * *